US011029084B2

(12) United States Patent
Thomas et al.

(10) Patent No.: US 11,029,084 B2
(45) **Date of Patent: *Jun. 8, 2021**

(54) LED LIGHTING ARRAY SYSTEM FOR ILLUMINATING A DISPLAY CASE

(71) Applicant: ElectraLED, Inc., Clearwater, FL (US)

(72) Inventors: James Thomas, Clearwater, FL (US); Vladimir Volochine, Clearwater, FL (US)

(73) Assignee: ElectraLED, Inc., Clearwater, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/201,570

(22) Filed: Nov. 27, 2018

(65) Prior Publication Data

US 2019/0093943 A1 Mar. 28, 2019

Related U.S. Application Data

(63) Continuation of application No. 15/645,747, filed on Jul. 10, 2017, now Pat. No. 10,139,156, which is a (Continued)

(51) Int. Cl.
*F25D 27/00* (2006.01)
*F21V 33/00* (2006.01)
(Continued)

(52) U.S. Cl.
CPC ..... *F25D 27/00* (2013.01); *A47F 11/10* (2013.01); *F21V 33/0024* (2013.01); *A47F 3/0482* (2013.01); *F21Y 2115/10* (2016.08)

(58) Field of Classification Search
CPC ..... F25D 27/00; A47F 11/10; A47F 3/0482; F21V 33/0024; F21Y 2115/10
See application file for complete search history.

(56) References Cited

U.S. PATENT DOCUMENTS 2,148,778 A * 2/1939 Seeger ..... F21V 33/00 362/94
3,936,686 A 2/1976 Moore
(Continued)

FOREIGN PATENT DOCUMENTS

JP 3142490 6/2008

OTHER PUBLICATIONS

PCT/US2009/005506 International Search Report and Written Opinion of the International Searching Authority dated May 12, 2010.

*Primary Examiner* — Rajarshi Chakraborty
*Assistant Examiner* — Glenn D Zimmerman
(74) *Attorney, Agent, or Firm* — Barnes & Thornburg LLP

(57) ABSTRACT

An LED lighting array system includes discrete lighting modules spatially arrayed along a support member to provide illumination of items within a display case. The modules have a low overall height that results in them being mounted in a low-profile configuration at various locations along the support member. The modules include a housing with opposed first and second sets of side apertures, a plurality of internal reflecting surfaces associated with the apertures, respectively, an external lens, a multi-sided light engine and a group of side-emitting LEDs. During operation, a first portion of light generated by the side-emitting LEDs is discharged through apertures and the lens into the cooler to illuminate contents therein, while a second portion of light generated by the side-emitting LEDs is redirected by the reflecting surface through said apertures and the lens into the cooler.

18 Claims, 6 Drawing Sheets

Related U.S. Application Data continuation of application No. 14/927,945, filed on Oct. 30, 2015, now Pat. No. 9,702,618.

(60) Provisional application No. 62/072,770, filed on Oct. 30, 2014.

(51) Int. Cl.

| | |
|---|---|
| ***A47F 11/10*** | (2006.01) |
| *A47F 3/04* | (2006.01) |
| *F21Y 115/10* | (2016.01) |

(56) References Cited

U.S. PATENT DOCUMENTS

| | | | |
|---|---|---|---|
| 4,143,411 | A | 3/1979 | Roberts |
| 4,149,217 | A | 4/1979 | Tucker |
| 4,416,411 | A | 11/1983 | Desmond et al. |
| 4,612,206 | A | 9/1986 | Shimozato et al. |
| 4,612,606 | A | 9/1986 | Roberts |
| 4,720,773 | A | 1/1988 | Ahroni |
| 4,855,882 | A | 8/1989 | Boss |
| 4,908,743 | A | 3/1990 | Miller |
| 5,015,918 | A | 5/1991 | Copeland |
| 5,103,382 | A | 4/1992 | Kondo et al. |
| 5,222,799 | A | 6/1993 | Sears et al. |
| 5,499,170 | A | 3/1996 | Gagne |
| 5,526,236 | A | 6/1996 | Burnes et al. |
| 5,607,227 | A | 3/1997 | Yasumoto et al. |
| 5,697,175 | A | 12/1997 | Schwartz |
| 5,746,497 | A | 5/1998 | Machida |
| 5,857,767 | A | 1/1999 | Hochstein |
| 5,892,192 | A | 4/1999 | Ishiguro et al. |
| 5,924,785 | A | 7/1999 | Zhang et al. |
| 5,931,577 | A | 8/1999 | Ishibashi |
| 6,045,240 | A | 4/2000 | Hochstein |
| 6,072,280 | A | 6/2000 | Allen |
| 6,116,748 | A | 9/2000 | George |
| 6,137,648 | A | 10/2000 | Higurashi |
| 6,167,648 | B1 | 1/2001 | Dimmick |
| 6,183,104 | B1 | 2/2001 | Ferrara |
| 6,244,728 | B1 | 6/2001 | Cote et al. |
| 6,283,612 | B1 | 9/2001 | Hunter |
| 6,346,777 | B1 | 2/2002 | Kim |
| 6,350,039 | B1 | 2/2002 | Lee |
| 6,371,637 | B1 | 4/2002 | Atchinson et al. |
| 6,394,626 | B1 | 5/2002 | McColloch |
| 6,396,466 | B1 | 5/2002 | Pross et al. |
| 6,416,200 | B1 | 7/2002 | George |
| 6,431,728 | B1 | 8/2002 | Fredericks et al. |
| 6,573,536 | B1 | 6/2003 | Dry |
| 6,578,979 | B2 | 6/2003 | Truttman-Battig |
| 6,578,986 | B2 | 6/2003 | Swaris et al. |
| 6,617,520 | B1 | 9/2003 | Martter et al. |
| 6,641,283 | B1 | 11/2003 | Bohler |
| 6,665,170 | B1 | 12/2003 | Warner et al. |
| 6,712,486 | B1 | 3/2004 | Popovich et al. |
| 6,815,724 | B2 | 11/2004 | Dry |
| 6,831,303 | B2 | 12/2004 | Dry |
| 6,846,093 | B2 | 1/2005 | Swaris et al. |
| 6,932,495 | B2 | 8/2005 | Sloan et al. |
| 7,114,831 | B2 | 10/2006 | Popovich et al. |
| 7,121,675 | B2 | 10/2006 | Ter-Hovhannisian |
| 8,201,977 | B2 | 6/2012 | Thomas et al. |
| 8,360,620 | B1 | 1/2013 | Rashidi |
| 8,789,299 | B2 | 7/2014 | Hoffman et al. |
| 8,985,795 | B2 | 3/2015 | Thomas et al. |
| 9,212,848 | B2 | 12/2015 | Kendall et al. |
| 9,702,618 | B2 * | 7/2017 | Thomas ..... F21V 33/0024 |
| 10,139,156 | B2 * | 11/2018 | Thomas ..... F21V 33/0024 |
| 2001/0015891 | A1 | 8/2001 | Suzuki et al. |
| 2003/0218878 | A1 | 11/2003 | Swaris et al. |
| 2005/0265019 | A1 | 12/2005 | Sommers et al. |
| 2005/0265035 | A1 | 12/2005 | Brass et al. |
| 2007/0047229 | A1 | 3/2007 | Lee |
| 2007/0159819 | A1 | 7/2007 | Bayat et al. |
| 2007/0159820 | A1 | 7/2007 | Crandell et al. |
| 2008/0007945 | A1 | 1/2008 | Kelly et al. |
| 2008/0055913 | A1 | 3/2008 | Sekela et al. |
| 2009/0135011 | A1 | 5/2009 | Oketani et al. |
| 2009/0195186 | A1 * | 8/2009 | Guest ..... H05B 45/375 315/294 |
| 2009/0206677 | A1 * | 8/2009 | Kulpin ..... H03K 3/57 307/113 |
| 2010/0097780 | A1 * | 4/2010 | Beatenbough ..... F21V 29/89 362/92 |
| 2010/0103672 | A1 | 4/2010 | Thomas et al. |
| 2011/0038145 | A1 | 2/2011 | Davenport et al. |
| 2011/0115358 | A1 | 5/2011 | Kim |
| 2011/0199005 | A1 | 8/2011 | Bretschneider |
| 2012/0014090 | A1 | 1/2012 | Hong |
| 2012/0127696 | A1 | 5/2012 | Glovatsky |
| 2013/0235590 | A1 * | 9/2013 | Van Der Sijde ..... F21V 7/0066 362/308 |
| 2013/0314916 | A1 | 11/2013 | Clore |
| 2014/0003047 | A1 | 1/2014 | Shimizu |
| 2014/0041105 | A1 * | 2/2014 | Zemlak ..... G01T 1/023 2/426 |
| 2014/0043811 | A1 | 2/2014 | Kawase |
| 2014/0159087 | A1 | 6/2014 | Tu et al. |
| 2014/0240983 | A1 * | 8/2014 | Lu ..... F21K 9/20 362/249.02 |
| 2015/0330834 | A1 | 11/2015 | Griffin et al. |
| 2016/0040860 | A1 * | 2/2016 | Thomas ..... F21V 19/001 362/92 |

* cited by examiner

LED LIGHTING ARRAY SYSTEM FOR ILLUMINATING A DISPLAY CASE

CROSS-REFERENCE TO RELATED APPLICATION

This application is a continuation of U.S. patent application Ser. No. 15/645,747, filed on Jul. 10, 2017, to be issued as U.S. Pat. No. 10,139,156, which is a continuation of U.S. patent application Ser. No. 14/927,945, filed on Oct. 30, 2015, issued as U.S. Pat. No. 9,702,618, which claims the benefit of U.S. Provisional Patent Application No. 62/072,770, filed on Oct. 30, 2014, both of which are incorporated in their entirety herein by reference.

TECHNICAL FIELD

The invention provides an LED lighting array system comprising discrete lighting modules that are spatially arrayed along a support member to provide illumination of items within a display case.

BACKGROUND

Many different types of conventional light fixtures are used to illuminate refrigerated display cases or coolers that house food and beverages, typically in grocery stores and convenience stores. These light fixtures use different types of light sources ranging from incandescent to halogen to light emitting diodes (LEDs). However, the light from these conventional fixtures is generally poorly controlled, which reduces the operating efficiency of the fixture and the cooler. Poorly controlled light falls outside the target area to be illuminated and/or does not properly illuminate that area, which degrades the appearance of the contents of the cooler (e.g. food or beverage products within the cooler). Also, poorly controlled light, even from low wattage sources such as LEDs, can cause glare to consumers standing or walking outside the cooler. In addition to ineffective illumination of the target area, poorly controlled light reduces the operating efficiency of the conventional fixture and the cooler which results in higher operating costs and increased wear on electrical components. This wasted light not only consumes excess energy, but distracts from the visual appearance of the target by illuminating areas outside of the target boundaries.

Moreover, conventional LED fixtures for use within refrigerated cases and coolers typically feature a large, elongated housing and an elongated light engine that includes a significant quantity of LEDs populating an elongated Printed Circuit Board (PCB). As a result, these conventional LED fixtures have large dimensions and accordingly only a small number of these fixtures may be installed within a cooler to illuminate the contents therein. Due to their large dimensions and space requirements, conventional LED fixtures have limited design applications and their configurations cannot be easily adjusted or tailored to meet the installation and performance requirements of different coolers, including coolers having different interior dimensions and configurations as well as different operating conditions.

Accordingly, there is a need for an LED lighting system fixture that precisely controls the generation and direction of the emitted light to efficiently illuminate a desired target area and minimizes illumination of areas surrounding the target area, and thereby improves the operating performance and efficiency of the system and cooler. There is also a need for an LED lighting system comprising multiple lighting modules that can be arrayed and installed within a cooler support member, thereby enabling the LED lighting system to be tailored to meet the installation and performance requirements of different coolers and different support members.

SUMMARY OF THE DISCLOSURE

Disclosed herein is an innovative LED lighting array system comprising discrete lighting modules that are spatially arranged along a support member to provide illumination of items within a display case, such as a refrigerated display cooler (or case or freezer) for food and/or beverages. The modules may have a low overall height that results in them being mounted in a low-profile configuration at various locations along the support member. The modules may include a housing having a first set of side apertures and a second set of side apertures, wherein the first and second sets of side apertures are configured in an opposed spatial relationship. The housing also may have a plurality of internal reflecting surfaces extending inward from a peripheral wall of the housing and associated with the apertures. An external lens may be configured to substantially mate with an upper extent of the housing when the module is in the assembled position. A multi-sided light engine may be positioned within the housing and may include a group of side-emitting LEDs associated with each of the side apertures.

During operation of the LED lighting array system, a first portion of light generated by the side-emitting LEDs is discharged through the apertures and the lens into the cooler to illuminate products therein. A second portion of light generated by the side-emitting LEDs is redirected by the reflecting surface through said apertures and the lens into the cooler. In this manner, the inventive LED lighting system fixture may precisely control the generation and direction of the emitted light to efficiently illuminate a desired target area within the cooler, and thereby improve the operating performance and efficiency of the system and cooler.

Additional features, advantages, and embodiments of the present disclosure may be set forth or apparent from consideration of the following attached detailed description and drawings. Moreover, it is to be understood that both the foregoing summary of the present disclosure and the following detailed description of figures are exemplary and intended to provide further explanation without limiting the scope of the present disclosure as claimed.

BRIEF DESCRIPTION OF THE DRAWINGS

To understand the present disclosure, it will now be described by way of example, with reference to the accompanying drawings in which.

Figure 1:
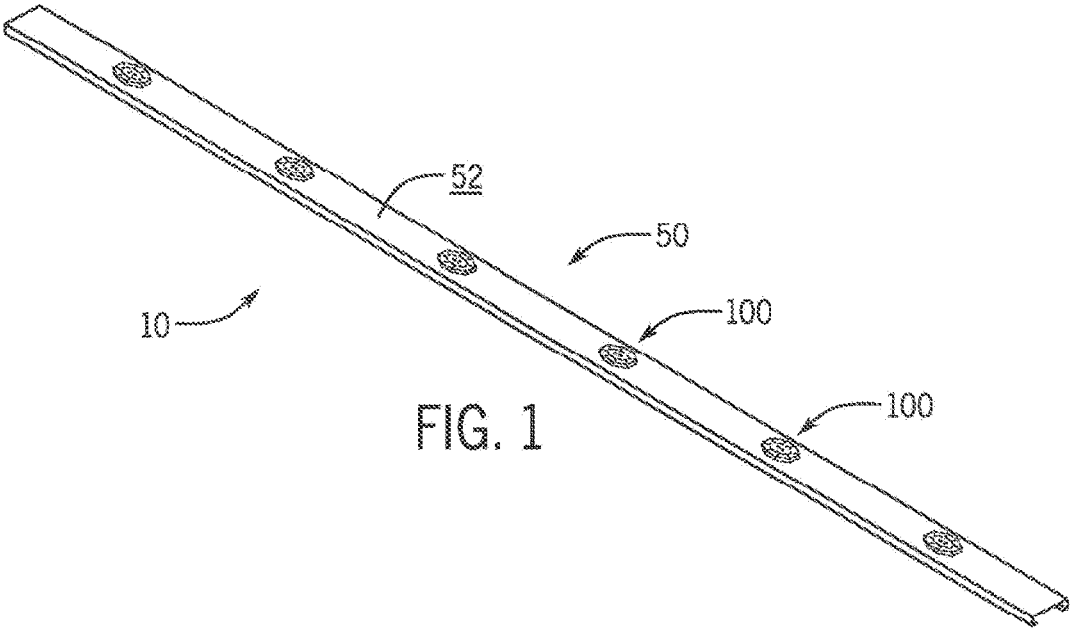
FIG. 1 is a perspective view of one or more embodiments of an LED lighting array system including six discrete LED lighting modules electrically connected and mounted to a support structure.

These drawings illustrate embodiments of the present disclosure and together with the detailed description serve to explain the principles of the disclosure. No attempt is made to show structural details of the present disclosure in more detail than may be necessary for a fundamental understanding of the disclosure and the various ways in which it may be practiced.

DETAILED DESCRIPTION

Exemplary embodiments of the present disclosure and the various features and advantageous details thereof are explained more fully with reference to the non-limiting embodiments and examples that are described and/or illustrated in the accompanying drawings and detailed in the following attached description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the present disclosure. The examples used herein are intended merely to facilitate an understanding of ways in which the present disclosure may be practiced and to further enable those of ordinary skills in the art to practice the embodiments of the present disclosure. Accordingly, the examples and embodiments herein should not be construed as limiting the scope of the present disclosure, which is defined solely by the appended claims and applicable law. Moreover, it is noted that like reference numerals represent similar parts throughout the several views of the drawings.

FIGS. 1-9 show an exemplary embodiment of an LED lighting array system 10 comprising discrete lighting modules 100 that are spatially arrayed along a support member 50 to provide illumination of items within a display case, such as a refrigerated display cooler (or case or freezer) for food and/or beverages. The support member 50 can be an integral part of the cooler's support frame, or a frame member of the cooler's door assembly. Depending on the size and configuration of the display cooler, multiple LED lighting array systems 10 may be installed within the cooler. An exemplary cooler has two corner (or end) frame members and a door assembly that includes a pair of doors separated by a central frame member, wherein each of these support members may include the LED lighting array system 10.

The system 10 is designed to provide modular flexibility with respect to the system's operating performance, including light output and energy consumption, such that the specific number of modules 100 installed within a support member 50 may be determined by an operator of the cooler. In this manner, the support member 50 may be configured with an appropriate number of modules 100. The number of modules 100 to install may be obtained by dividing the total required luminous flux by the luminosity of a single module 100. As shown in FIG. 1, the discrete modules 100 may be separated along the support member 50 by an appreciable distance that may be a function of total required luminous flux, cooler dimensions and configuration, and support member 50 dimensions and configuration. Rather than having to punch or cut a number of holes in the inner walls and/or frame of the cooler, the system 10 may be installed by merely affixing the support member 50 within the cooler to illuminate a desired target area. In this manner the system 10, including the support member 50 and the modules 100, may be installed as either original equipment or retrofitted to an existing cooler.

The modules 100 within a particular support member 50 may be electrically connected in a daisy-chain manner with common leads to a power supply (not shown) that may be installed within the support member 50. Interconnection between individual modules 100 may be accomplished by crimping or soldering two lines of continuous leads (or wires) to connectors or solder pads affixed to a printed circuit board (PCB) within the module 100. One end of each lead may be connected to the power supply, which in one embodiment is a constant voltage, 24 Volt power supply. The maximum number of modules 100 that can be used in a configuration of the system 10 may be determined by dividing the maximum power provided by the power supply by the power consumed by a single module 100 during operation. As the system 10 is modular, a specific module 100 may be easily removed from the support member 50 and replaced or serviced.

Referring to the Figures, the LED module 100 may include an external lens 110, an opaque housing 120, an internal light engine 140, a first mounting bracket 150 a peripheral gasket (or seal) 160, a second bracket 170 and a fastener 180. The first and second brackets 150, 170 and the fastener 180 may be collectively used to secure the module 100 within an aperture or recess formed in the support member 50. The support member 50 may be be configured as an elongated metal extrusion or a flexible extrusion formed from plastic, such as vinyl, or another polymer. In one embodiment, the lens 110 and/or the housing 120 are injection molded from a polymer, such as a synthetic plastic. The modules 100 may have a low overall height that enables them to be mounted in a low-profile configuration at various locations along the support member 50. One preferred embodiment of the module 100 has an overall height of less than 0.5 inch, preferably less than 0.35 inch, and most preferably less than 0.275. The low overall height of the module 100 is an essential design factor because it allows the system 10 to have a low-profile configuration and provides a reduced form factor that minimizes the space needed for the system 10, which increases the usable volume and capacity of the cooler in which the system 10 is installed.

Figure 7:
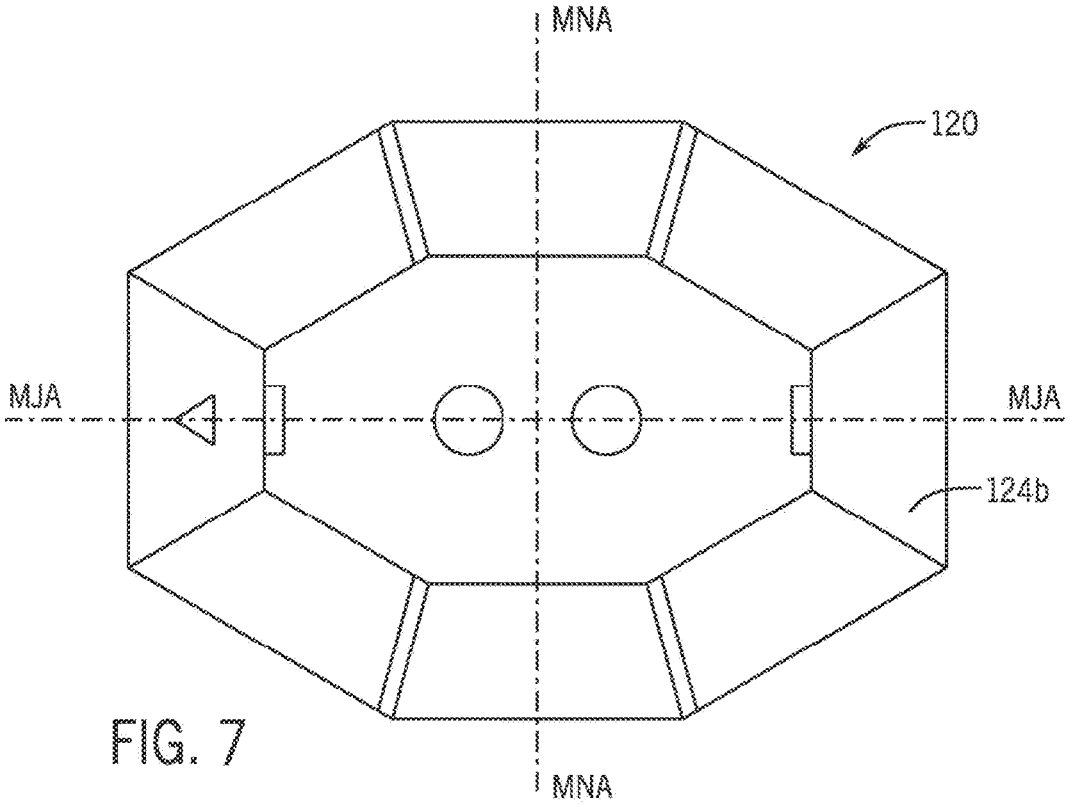
FIG. 7 is a top plan view of the housing of the LED lighting module of FIG. 1.
Figure 8:
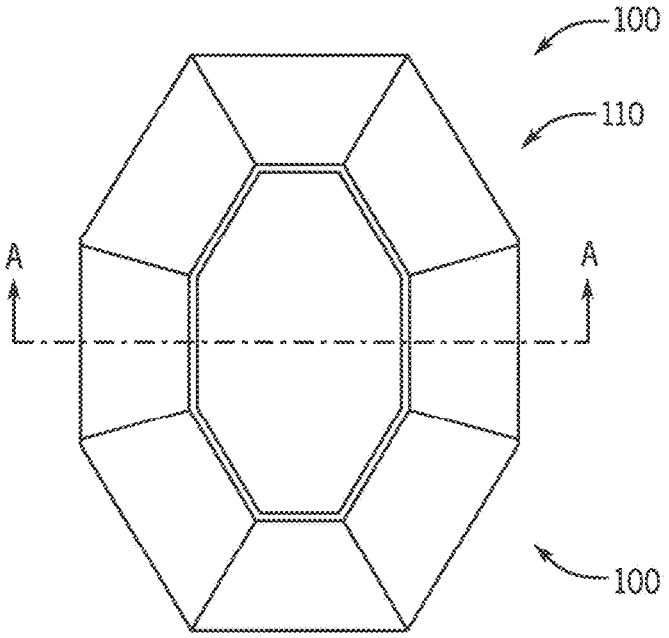
FIG. 8; is a top plan view of the LED lighting module of FIG. 1.

As shown in FIGS. 4-7, the housing 120 has a multi-contour configuration provided by a peripheral wall arrangement 122, an intermediate wall arrangement 124 extending upward from the peripheral wall arrangement 122, and a top wall 126. These walls interact to provide a first set of apertures **128*a* arranged along a first side 120*a* of the housing 120 and a second set of apertures 128*b* arranged along a second side 120*b* of the housing 120. As discussed below, the first and second set of apertures 128*a*, 128*b* are configured to allow light generated by the light engine 140 to pass through the housing 120. The intermediate wall arrangement 124 comprises minor intermediate walls 124*a*** and major intermediate walls 124*b*, wherein the major intermediate walls 124*b* are located at opposed ends of the housing 120. A vertex 125 is defined where the intermediate walls 124 meet the upper edge of the peripheral wall 122. Referring to FIG. 7 (in which the lens 110 is omitted), the major axis MJA extends longitudinally through the major intermediate walls 124. The minor intermediate walls 124*a* are located along the side portions of the housing 120 and define the apertures 128*a*, 128*b*, wherein a minor axis MNA extends laterally through one of each of the first and second sets of apertures 128*a*, 128*b*. Referring to FIG. 1, which shows six modules 100 of the system 10 disposed on the support member 50 in a vertical configuration, the major axis MJA is oriented along a longitudinal or vertical axis of the support member 50 and the minor axis MNA is oriented substantially perpendicular to the longitudinal axis of the support member 50.

The housing 120 also includes an arrangement of reflecting surfaces 130 extending inward from the peripheral wall arrangement 122 to a base wall 132 that extends downward from a lower surface wall arrangement 133. The arrangement of the base wall 132 may define a lower, internal periphery of the housing 120 that is within the peripheral wall arrangement 122. The base wall 132 has opposed ends wherein each end may include a securing element 135 that engages and/or secures the light engine 140, mounting bracket 150 or both using a snap-fit assembly. The securing elements 135 and snap-fit assembly may provide enhanced heat dissipation properties during module operation, and may also facilitate module 100 and support member 50 mounting. Due to its multi-contour configuration, the housing 120 features an internal cavity or receiver 134 that receives the light engine 140 when the module 100 is assembled. The receiver 134 is bounded by the base wall 132 and the top wall 126.

A first set of reflecting surfaces 130*a* are associated with the first set of apertures 128*a*, and a second set of reflecting surfaces 130*b* are associated with the second set of apertures 128*b*. Referring to the cross-sectional view of FIG. 9, the reflecting surfaces 130 may be sloped or angled downward as the reflecting surfaces 130 extend inward from the lower peripheral wall arrangement 122 to the base wall 132. In other words, the reflecting surfaces 130 define an orientation angle Θ with the mounting surface 52 of the support member 50. Depending upon the design parameters of the module 100 and the mounting surface 52, the orientation angle Θ may vary between 0 and 90 degrees. To enhance reflection properties, the reflecting surfaces 130 can be coated with a metallization layer. The external lens 110 is cooperatively dimensioned with the housing 120 to include a corresponding multi-contour configuration. The lens 110 also includes at least one projection 112 that is received by an opening 136 in the top housing wall 126 and an opening 144*f* in the light engine 140 to facilitate securement of these components. In one embodiment, the projection 112 is heat-treated near the rear surface of the light engine 140 to join and secure the lens 110, housing 120, and light engine 140 together. The lens 110 can be configured to cover at least walls 124, 126 and not obscure the apertures 128, 128*a*, 128*b*.

Figure 3A:
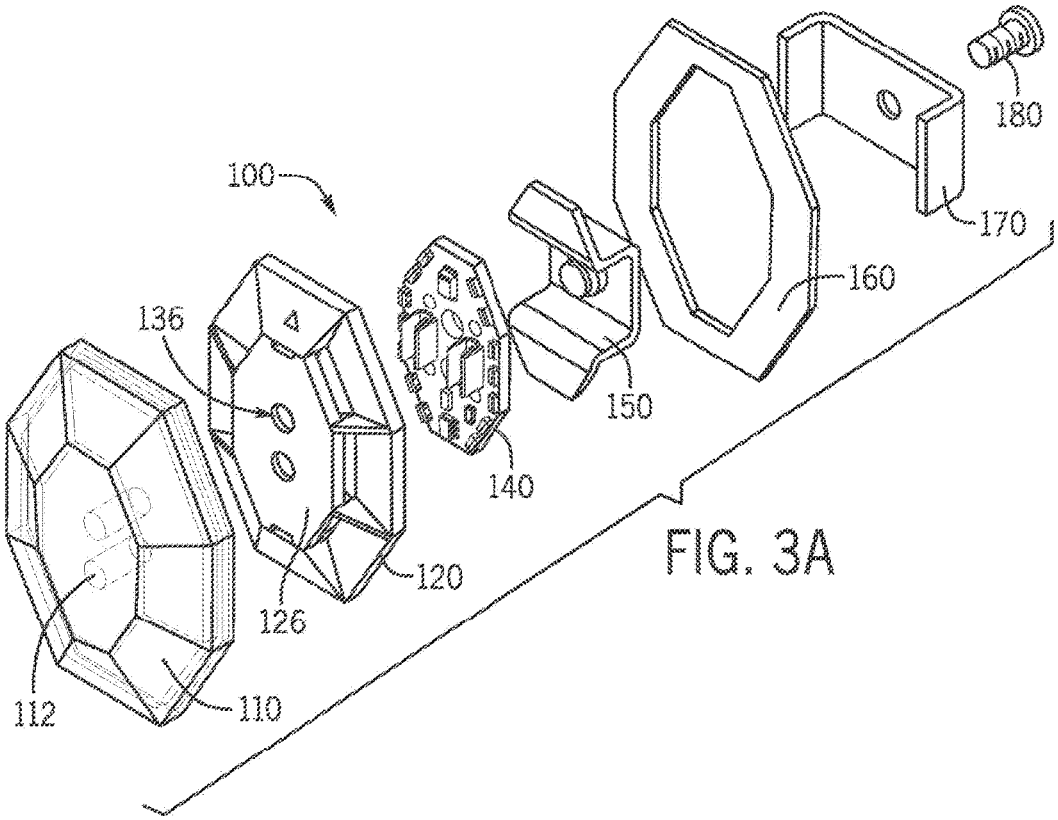
FIG. 3A is an exploded perspective view of the LED lighting module of FIG. 1.
Figure 3B:
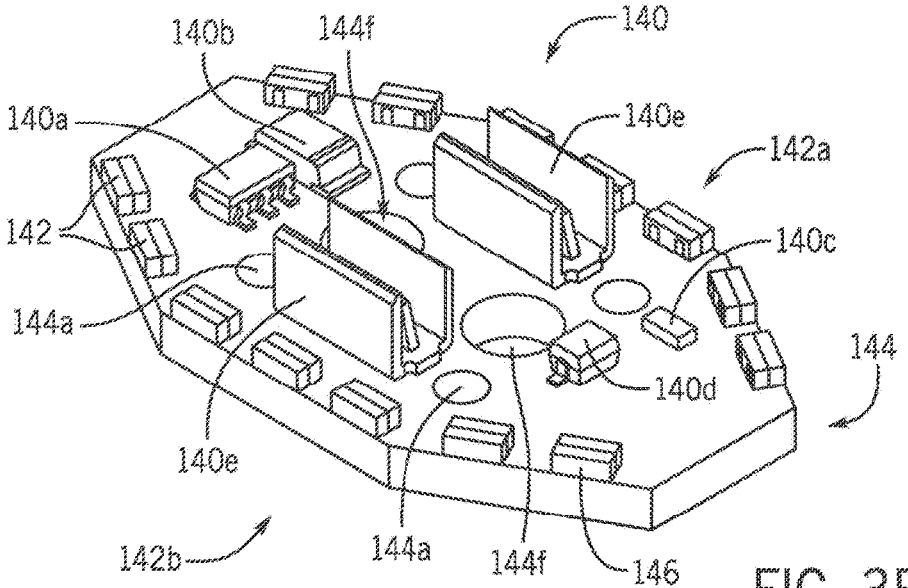
FIG. 3B is a top perspective view of a light engine of the LED lighting module of FIG. 1.
Figure 4:
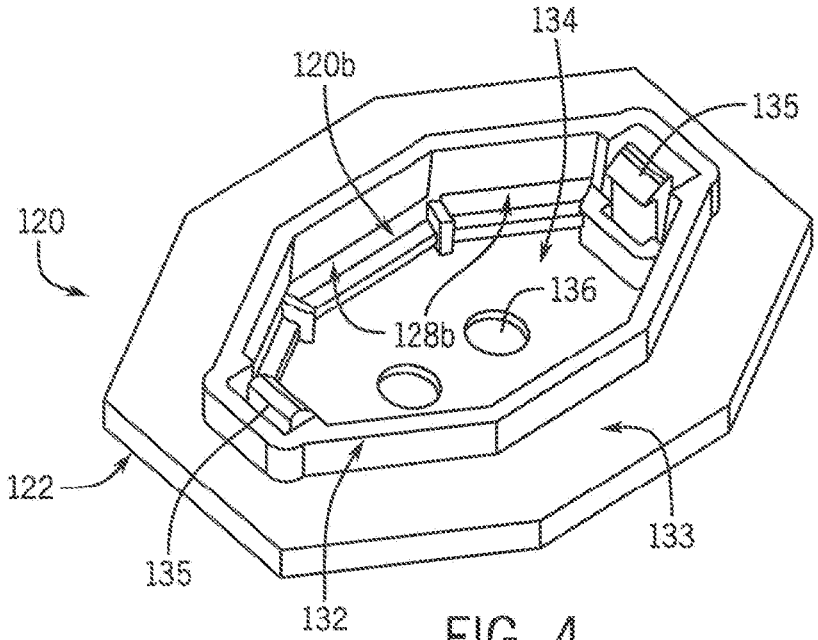
FIG. 4 is a bottom perspective view of a housing of the LED lighting module of FIG. 1.
Figure 5:
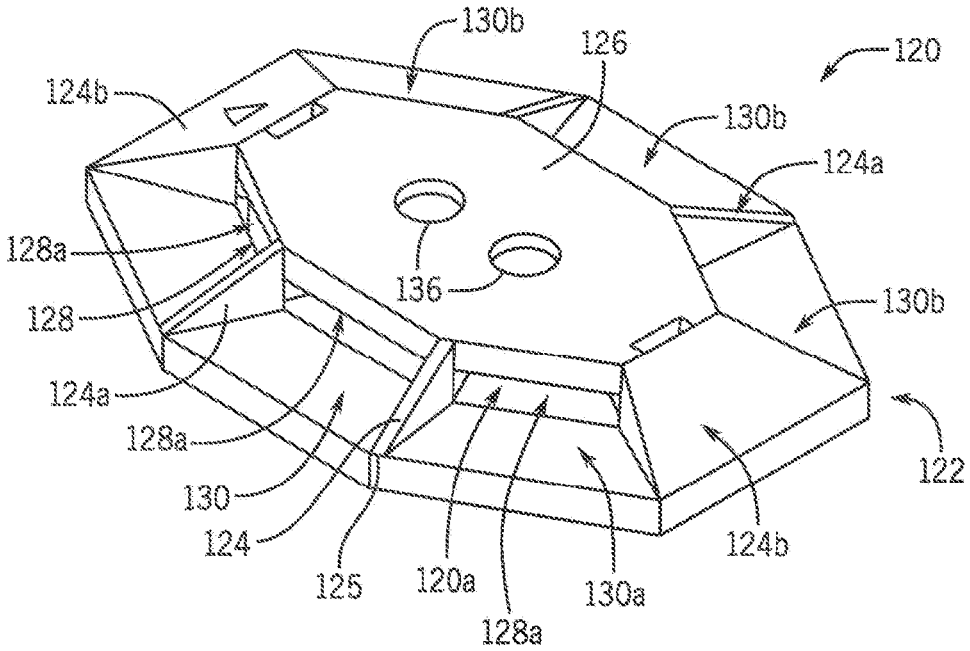
FIG. 5 is a top perspective view of the housing of the LED lighting module of FIG. 1.
Figure 6:
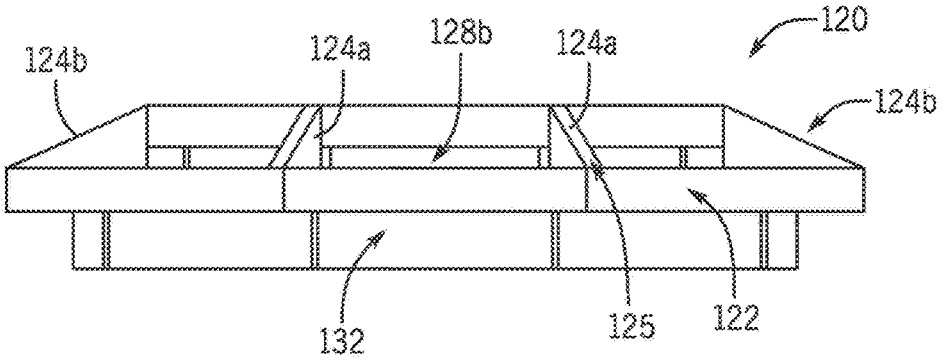
FIG. 6 is a side perspective view of the housing of the LED lighting module of FIG. 1.

As shown in FIG. 3B, the light engine 140 includes a first set of light emitting diodes (LEDs) 142*a* and a second set of LEDs 142*b*, both mechanically and electrically connected to a printed circuit board (PCB) 144. The light engine 140 may also include other components to maximize operating performance of the module 100, such as a linear current regulator 140*a*, protective diode 140*b*, ballast resistor 140*c*, transient voltage suppressor 140*d* and insulation displacement connectors 140*e*. Referring to FIG. 3B, each connector 140*e* may be positioned adjacent to a pair of apertures 144*a*, wherein the aperture 144*a* may receive an extent of a lead that interconnects modules 100 and the power supply. Thus, the lead may extend through two apertures 144*a* and the connector 140*e* to supply power to each set of LEDs 142*a*, 142*b*. The PCB 144 also may include at least one opening 144*f*, preferably positioned in a central region of the PCB 144 that receives an extent of the projection 112 of the lens 110.

The LEDs 142 are of the side-emitting variety designed to emit light only 180 degrees along an emitting surface 146, which is oriented perpendicular to the PCB 144. The side-emitting LEDs 142 may be arranged along the periphery of the PCB 144, which preferably has an octagonal configuration, and wherein the LEDs 142 may be preferably arranged along six of the eight sides of the PCB 144. The PCB 144 may have an aluminum substrate and a configuration that allows the PCB 144 to fit within the receiver 134. In one embodiment, each of the first and second sets of LEDs 142*a*, 142*b* includes 7 distinct LEDs, wherein the middle group of each set includes three LEDs 142 and the two outer groups of each set include two LEDs 142. Due to an octagonal configuration of the PCB 144, the middle group of three LEDs 142 (from the first and second sets) are arranged opposite each other, and the outer groups of two LEDs 142 (from the first and second sets) may also be oppositely arranged. Each of the six LED groups is associated with a specific aperture 128 formed in the housing 120. As such, the two middle groups of LEDs 142 are associated with the middle apertures 128 and the four outer groups of LEDs 142 are associated with the outer apertures 128.

Figure 9:
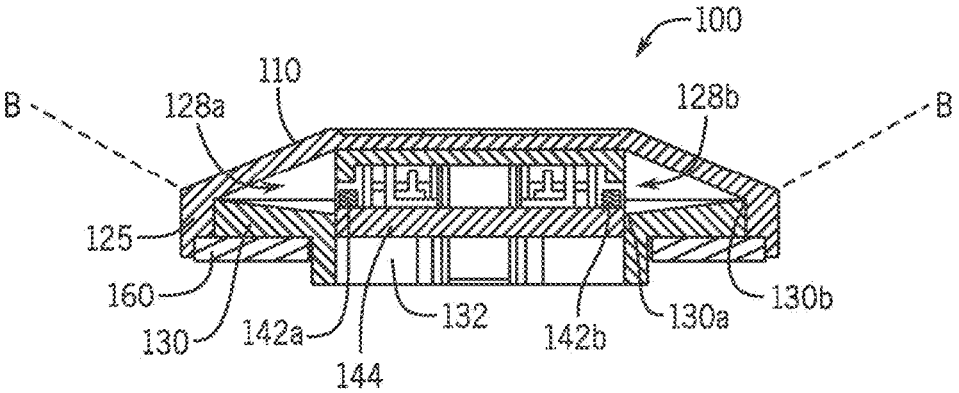
FIG. 9 is a cross-section view of the LED lighting module taken along line A-A of FIG. 8, showing exemplary light paths extending through the module during operation.

Referring to the cross-section of the module 100 in FIG. 9, an upper surface of the PCB 144 and a mid-height of the LEDs 142 are positioned above the inner edge 130*a* of the reflector 130. However, the upper surface of the PCB 144 and the mid-height of the LEDs 142 are positioned below the outer edge 130*b* of the reflector 130. In other words, the outer reflector edge 130*b* is located above the upper surface of the PCB 144 and the mid-height of the LEDs 142. These positional relationships of the housing 120 and the light engine 140 can increase the maximum operating performance of the module 100, including light generation and management with respect to the light provided within the cooler to illuminate objects therein.

When the system 10 is installed with a central support member 50, which is located at an intermediate region of the cooler and not at one end of the cooler, the modules 100 may be configured with both the first and second sets of LEDs 142*a*, 142*b*. However, when the system 10 is installed within a support member 50 located at an end of the cooler, or when the module 100 is installed at an end of a support member 50, the module 100 may be configured with only a single set of LEDs 142. Further, such a single set of LEDs 142 may populate only one side 120*a*, 120*b* of the module 100. Again referring to the cross-section of FIG. 9, the lower portions of the lens 110 and the housing 120 may define a peripheral gap configured to receive the gasket 160 to seal the module 100 against support member 50. The gasket 160 is intended to provide thermal and vibrational insulation, as well as sealing regarding moisture and light.

Figure 2:
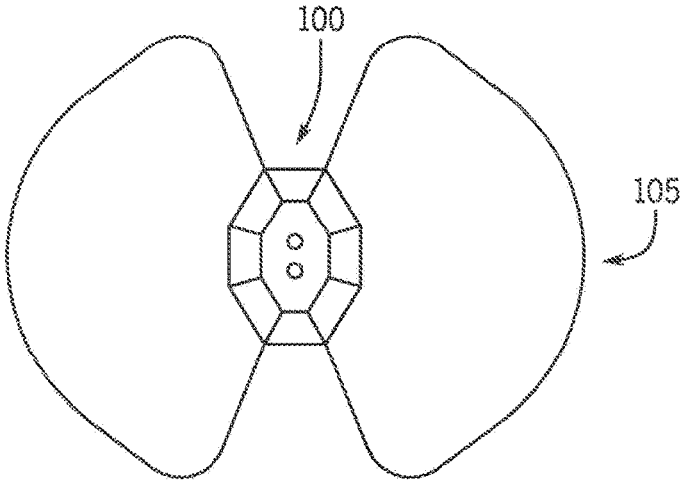
FIG. 2 is a top view of an LED lighting module of FIG. 1, showing an exemplary distribution pattern of light emitted by the module during operation.

FIG. 2 is a top view of the module 100 showing, in two dimensions, an exemplary light distribution pattern 105 emitted by the light engine 140 through the module 100. Referring to the cross-section of FIG. 9, the side-emitting LEDs 142 may emit light only 180 degrees along the LED emitting surface 146, wherein that surface is substantially perpendicular to an external edge of the PCB 144. The modules 100 may also emit light substantially along a plane of the mounting surface 52 while limiting light emitted along a plane perpendicular to the plane of the mounting surface 52. As the housing 120, including the top wall 126, is preferably opaque, stray light generated by the side-emitting LEDs 142 may be prevented from passing through the housing 120. The strongest or maximum intensity beam of emitted light from the LED 142 is aligned with the mid-height of the LED 142 and is shown by the reference beam B. In the installed position, the maximum intensity beam B is oriented substantially parallel to the support surface 52 of the elongated support member 50 shown in FIG. 1. The maximum intensity beam B is also oriented substantially parallel to the front face of the cooler and the cooler doors. The maximum intensity beam B is reflected by the reflecting surface 130 through the apertures 128 and lens 110 into the cooler. Preferably, the point of reflection on the surface 130 is below the vertex 125, which is where the intermediate wall 124 meets the upper edge of the peripheral wall 122. The maximum intensity beam B that is generated by the middle group of LEDs 142 within each of the first and second set of LEDs 142*a,b* is oriented substantially perpendicular to the major axis MJA and substantially parallel to the minor axis MNA of the module 100. When the system 10 is installed with the elongated support member 50 oriented vertically within the cooler, the maximum intensity beam B that is generated by the middle group of LEDs 142 is oriented substantially perpendicular to a vertical or major axis of the support member 50, and substantially parallel to a horizontal or minor axis of the support member 50. Due to the angular configuration of the PCB 144, the outer groups of LEDs 142 are oriented at an angle to both axes MJA, MNA and the maximum intensity beam B generated by the LEDs 142 in those groups may be angularly oriented to both the major axis MJA and the minor axis MNA of the module 100.

The side-emitting LEDs 142 also emit beams of light below the maximum intensity beam B wherein these lower light beams are reflected by the reflecting surface 130 through the aperture 128 and lens 110 into the cooler. Beams of light emitted by the LED 142 above the maximum intensity beam B may pass through the aperture 128 and lens 110 into the cooler without being reflected by the reflecting surface 130. Maximizing the upper beams of light that pass through the apertures 128 without reflection may improve operating performance of the module 100 because those beams have a greater intensity because reflection generally reduces beam intensity. In this manner, the module 100, and the shape, size and arrangement of housing 120, internal light engine 140 and external lens 110 features, are designed with a low-profile configuration to maximize the amount of light generated by the light engine 140 for transmission through the module 100 and into the cooler while minimizing both the area of the angled reflecting surface 130 and the power consumed by the light engine 140. These structural and performance attributes eliminate or reduce glare observed by people walking along a store aisle having a cooler(s) and then accessing the cooler or the items displayed therein. As the modules 100 operate efficiently, from both power consumption and light usage standpoints, the system 10 can be precisely configured for use with the support member 50. This allows the owner or operator of the cooler to accurately determine the number and density of modules 100 to be installed with the support members 50 of the cooler and thereby maximize the efficiency of the system 10 and minimize the material and operating costs of the system 10 and the cooler. In this manner, during operation of the LED lighting array system 10, a first portion of light generated by the side-emitting LEDs 142 is discharged through the apertures 128 and the lens 110 into the cooler to illuminate the contents and interior of the cooler, and a second portion of light generated by the side-emitting LEDs 142 is redirected by the reflecting surface 130 through said apertures 128 and the lens 110 into the cooler to illuminate the contents and interior of the cooler.

Figure 10:
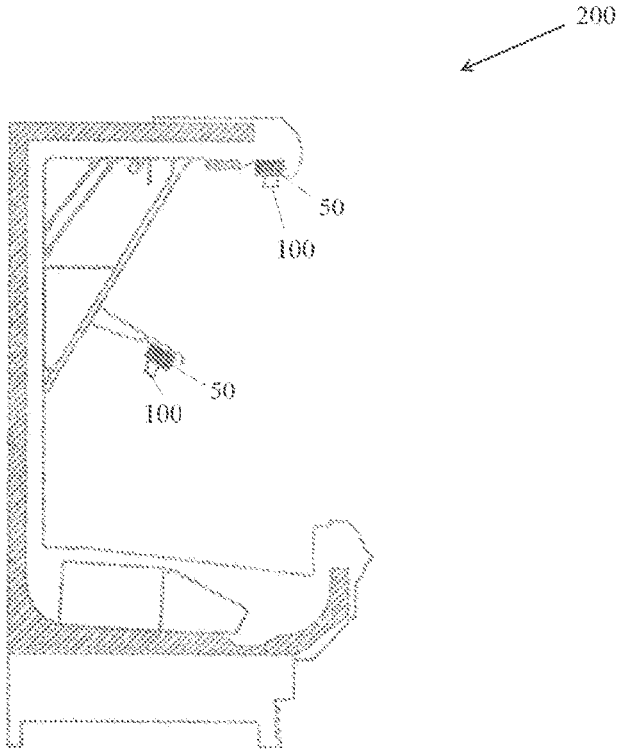
FIG. 10 is a cross-section side view of a cooler with the LED lighting module of FIG. 1.

As the amount of light that is generated by the light engine 140 and then passes through the module 100 is a function of its internal configuration, the light engine 140 and the reflecting surfaces 130 can be adjusted while retaining the system's 10 low-profile configuration, including the dimensions of the lens 110. For example, the thickness of the PCB 144 can be reduced, which changes the position of the side-emitting LED 142 and the resulting maximum intensity beam B relative to the reflecting surface 130, thus increasing the quantity of light directly discharged through the housing 120 without reflection into the cooler. In another example, the thickness of the PCB 144 may be increased, which elevates the side-emitting LED 142 and the resulting maximum intensity beam B relative to the reflecting surface 130, thus increasing the quantity of light reflected by the reflection surfaces 130 before being discharged through the apertures 128 of the housing 120 and into the cooler. In another example, the dimensions of the reflection surface 130 (e.g., slope or height) may be adjusted, which changes how the maximum intensity beam B and lower light beams are reflected through the apertures 128 into the cooler. Accordingly, housings 120 having different configurations of the reflection surfaces 130 can be used with the same light engine 140 (and lens 110) to yield different performance characteristics for the module 100. As a result, the utility and flexibility of the module 100, and thereby the system 10, are significantly increased. For example, a cooler 200 may have an arrangement of support members 50, each member 50 includes one or more modules 100, as shown in FIG. 10.

While the present disclosure has been described in terms of exemplary embodiments, those skilled in the art will recognize that the present disclosure can be practiced with modifications in the spirit and scope of the appended claims. These examples given above are merely illustrative and are not meant to be an exhaustive list of all possible designs, embodiments, applications or modifications of the present disclosure.

A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting array system featuring light emitting diodes (LEDs) for use with at least one support member within a refrigerated cooler to illuminate products residing within the cooler, the lighting array system comprising:

a light engine that includes a linear current regulator, a protective diode, a ballast resistor, a transient voltage suppressor and an insulation displacement connector; and at least one module configured to be installed within a support member, each module comprising:

a housing having a first aperture and a second aperture, a first internal reflecting surface extending outward from the first aperture, and a second internal reflecting surface extending outward from the second aperture, an external lens configured to substantially overlie an upper extent of the housing, a first LED associated with the first aperture, a second LED associated with the second aperture, and wherein during operation of the lighting array system, a first portion of light generated by said first and second LEDs is discharged through the lens, and a second portion of light generated by said first and second LEDs is redirected by the reflecting surface through the lens.

2. The lighting array system of claim 1, further comprising a plurality of modules configured to be installed an appreciable distance apart within the support member.

3. The lighting array system of claim 1, wherein the module is positioned within an aperture that is formed within the support member.

4. The lighting array system of claim 1, wherein the first internal reflecting surface is oriented at an upward angle as said reflecting surface extends outward from the first aperture.

5. The lighting array system of claim 1, wherein the support member is integrated into an extent of a support frame of the refrigerated cooler.

6. The lighting array system of claim 1, wherein each module is symmetrical about a major axis of the module and a minor axis of the module.

7. The lighting array system of claim 1, wherein the first and second LEDs are side-emitting LEDs.

8. The lighting array system of claim 1, wherein the first and second apertures are side apertures and are in an opposed positional relationship to one another.

9. The lighting array system of claim 1, wherein a maximum intensity of the light output from the first LED of the first module is orientated substantially parallel with a front extent of the refrigerated cooler and a maximum intensity of the light output from the first LED of the second module is orientated substantially parallel with a front extent of the refrigerated cooler.

10. A refrigerated cooler that displays products residing within the cooler, the cooler having a lighting array system to illuminate products within the cooler, the cooler comprising:

an arrangement of internal support members;

a lighting array system installed within the cooler and including:

a first module installed within a support member of the cooler, a second module installed within said support member a distance from the first module, said first and second modules each including a housing having:

a first aperture, a first internal reflecting surface extending outward from the first aperture, a first LED, an external lens configured to substantially overlie an upper extent of the housing and an extent of the first LED, and wherein during operation of the lighting array system, a first portion of light generated by the first LED of the first module is discharged through the lens of the first module into the cooler to illuminate the products and a first portion of light generated by the first LED of the second module is discharged through the lens of the second module into the cooler to illuminate the products.

11. The refrigerated cooler of claim 10, further comprising a second aperture in an opposed positional relationship with the first side aperture and a second internal reflecting surface extending outward from the second aperture.

12. The refrigerated cooler of claim 10, wherein a second portion of light generated by first LED of the first module is redirected by the reflecting surface of the first module through the lens of the first module into the cooler to illuminate the products and a second portion of light generated by first LED of the second module is redirected by the reflecting surface of the second module through the lens of the second module into the cooler to illuminate the products.

13. The refrigerated cooler of claim 10, wherein each module is symmetrical about a major axis of the module.

14. The refrigerated cooler of claim 10, further comprising a light engine that includes a linear current regulator, a protective diode, a ballast resistor, a transient voltage suppressor and an insulation displacement connector.

15. The refrigerated cooler of claim 10, wherein a maximum intensity of the light output from the first LED of the second module is orientated substantially parallel with a front extent of the refrigerated cooler.

16. The refrigerated cooler of claim 11, wherein the first and second modules each include a second LED; and wherein during operation of the lighting array system, a first portion of light generated by second LED of the first module is discharged through the lens of the first module into the cooler to illuminate the products, and a second portion of light generated by second LED of the first module is redirected by the reflecting surface through the lens of the first module into the cooler to illuminate the products.

17. A lighting array system featuring light emitting diodes (LEDs) for use within a refrigerated cooler to illuminate products residing within the cooler, the lighting array system comprising:

an internal support member that includes an opening formed therein, said internal support member is designed to be integrated into a support frame member of the cooler;

a module positioned within said opening formed within the support member, said module comprising:

a housing having a first aperture and an internal reflecting surface, a first LED associated with the first aperture;

an external lens configured to overlie an extent of the housing and the first LED, and wherein during operation of the lighting array system, a first portion of light generated by said first LED is discharged through the lens, and a second portion of light generated by said first LED is redirected by the reflecting surface through the lens; and wherein a maximum intensity of the light output from the first LED is orientated substantially parallel with a front extent of the refrigerated cooler.

18. The lighting array system of claim 17, wherein the module is symmetrical about a major axis of the module.

* * * * *